US007267162B2

(12) United States Patent
Bhatti et al.

(10) Patent No.: US 7,267,162 B2
(45) Date of Patent: Sep. 11, 2007

(54) LAMINATED EVAPORATOR WITH OPTIMALLY CONFIGURED PLATES TO ALIGN INCIDENT FLOW

(75) Inventors: Mohinder Singh Bhatti, Amherst, NY (US); Mingyu Wang, Amherst, NY (US); Lin-Jie Huang, East Amherst, NY (US); Gary Scott Vreeland, Medina, NY (US)

(73) Assignee: Delphi Technologies, Inc., Troy, MI (US), .

( * ) Notice: Subject to any disclaimer, the term of this patent is extended or adjusted under 35 U.S.C. 154(b) by 98 days.

(21) Appl. No.: 11/149,701

(22) Filed: Jun. 10, 2005

(65) Prior Publication Data

US 2006/0278382 A1 Dec. 14, 2006

(51) Int. Cl.
*F29D 1/03* (2006.01)

(52) U.S. Cl. ..... 165/152; 165/151

(58) Field of Classification Search ..... 165/151–153
See application file for complete search history.

(56) References Cited

U.S. PATENT DOCUMENTS 2,423,175 A * 7/1947 Churchill et al. ..... 165/159
4,011,905 A * 3/1977 Millard ..... 165/153
4,116,271 A 9/1978 De Lepeleire
4,209,061 A 6/1980 Schwemin
4,489,778 A 12/1984 Skoog
4,618,020 A * 10/1986 Noda et al. ..... 180/229
4,813,478 A 3/1989 Jonsson
5,209,285 A * 5/1993 Joshi ..... 165/153
6,050,328 A * 4/2000 Shikazono et al. ..... 165/151
6,155,338 A 12/2000 Endou
6,364,008 B1 4/2002 Mannoni
6,374,910 B2 4/2002 Tsunoda
6,523,606 B1 2/2003 Dienhart
2005/0199378 A1* 9/2005 Lamich et al. ..... 165/151

FOREIGN PATENT DOCUMENTS

JP 1-306797 * 12/1989

* cited by examiner

*Primary Examiner*—Teresa J. Walberg
(74) *Attorney, Agent, or Firm*—Patrick M. Griffin

(57) ABSTRACT

The invention provides a heat exchanger having a plurality of plates stacked in alternating mirrored relation with one another. Each of the plurality of plates has a plate length extending along a plate longitudinal axis between first and second ends. Each of the plurality of plates also has a plate width extending transverse to the plate longitudinal axis. The plurality of plates cooperate to define a fluid receiving cavity extending along a receiving axis substantially perpendicular to the plate longitudinal axis. The plurality of plates also cooperate to define a fluid exiting cavity extending along an exiting axis substantially perpendicular to the plate longitudinal axis and spaced from the receiving axis. A plurality of plate cavities are defined between alternating pairs of adjacent plates and extend along the plate length. The plurality of plate cavities fluidly communicate with both of the receiving and exiting cavities. The plate width is disposed at an angle less than ninety degrees relative to both of the receiving and exiting axis.

19 Claims, 13 Drawing Sheets

LAMINATED EVAPORATOR WITH OPTIMALLY CONFIGURED PLATES TO ALIGN INCIDENT FLOW

FIELD OF THE INVENTION

The invention relates to a heat exchanger and more particularly to a heat exchanger formed from a plurality of layered plates wherein fluid passageways are defined between alternating pairs of plates.

BACKGROUND OF THE INVENTION

Heat exchangers such as evaporators can be used in heating, ventilation and air conditioning (HVAC) systems. A typical evaporator used in the HVAC modules of automotive air conditioning systems includes a core formed by pairs of embossed plates joined together to create a plurality of flow tubes for the refrigerant tubes in the interior of the core. Fins are disposed between the refrigerant flow tubes to permit ambient air to flow across the exterior of the tubes and exchange thermal energy with the refrigerant. The tubes are in fluid communication with a pair of spaced tanks formed out of the plates themselves comprising a plurality of cups punched at two ends of plates. Since the process of stacking plates and fins in the construction of the evaporator core is a laminating process, these evaporators are referred to as the laminated type of evaporators.

Generally, the evaporator core is placed in an HVAC module of the air conditioning system directly at the diffuser section of the HVAC module. Often, the incoming airflow must turn through a sharp angle in order to enter the air passages between the plate tubes of the evaporator. Associated with the sharp bending of the flow path lines is a pressure drop penalty.

SUMMARY OF THE INVENTION

The invention provides a heat exchanger having a plurality of plates stacked in alternating mirrored relation with one another. Each of the plurality of plates has a plate length extending along a plate longitudinal axis between first and second ends. Each of the plurality of plates also has a plate width extending transverse to the plate longitudinal axis. The plurality of plates cooperate to define a fluid receiving cavity extending along a receiving axis substantially perpendicular to the plate longitudinal axis. The plurality of plates also cooperate to define a fluid exiting cavity extending along an exiting axis substantially perpendicular to the plate longitudinal axis and spaced from the receiving axis. A plurality of plate cavities are defined between alternating pairs of adjacent plates and extend along the plate length. The plurality of plate cavities fluidly communicate with both of the receiving and exiting cavities. The plate width is disposed at an angle less than ninety degrees relative to both of the receiving and exiting axis.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
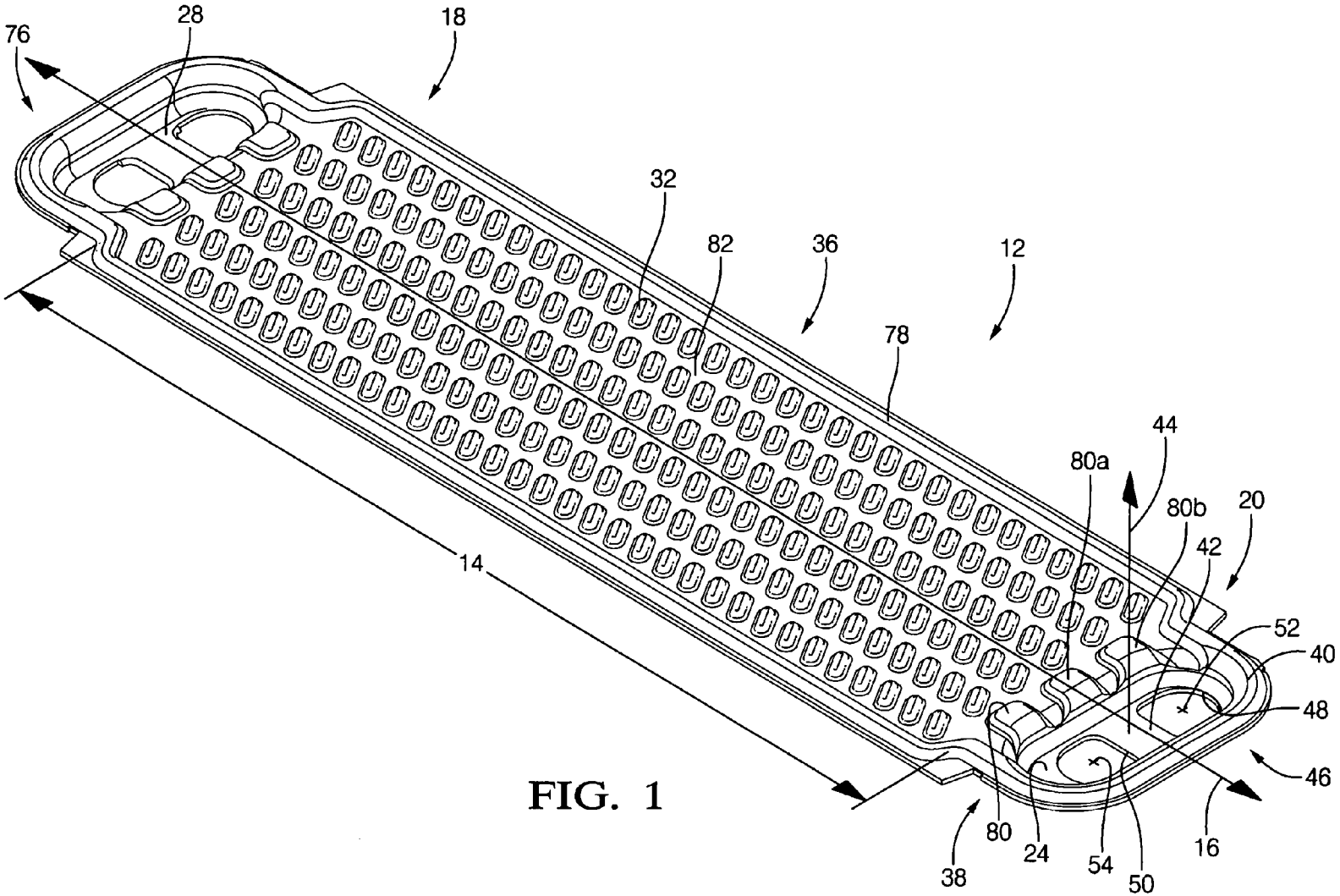
FIG. 1 is a perspective view of a first plate according to a first exemplary embodiment of the invention.

A plurality of different embodiments of the invention are shown in the Figures of the application. Similar features are shown in the various embodiments of the invention. Similar features have been numbered with a common reference numeral and have been differentiated by an alphabetic designation. Also, to enhance consistency, features in any particular drawing share the same alphabetic designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

Figure 19:
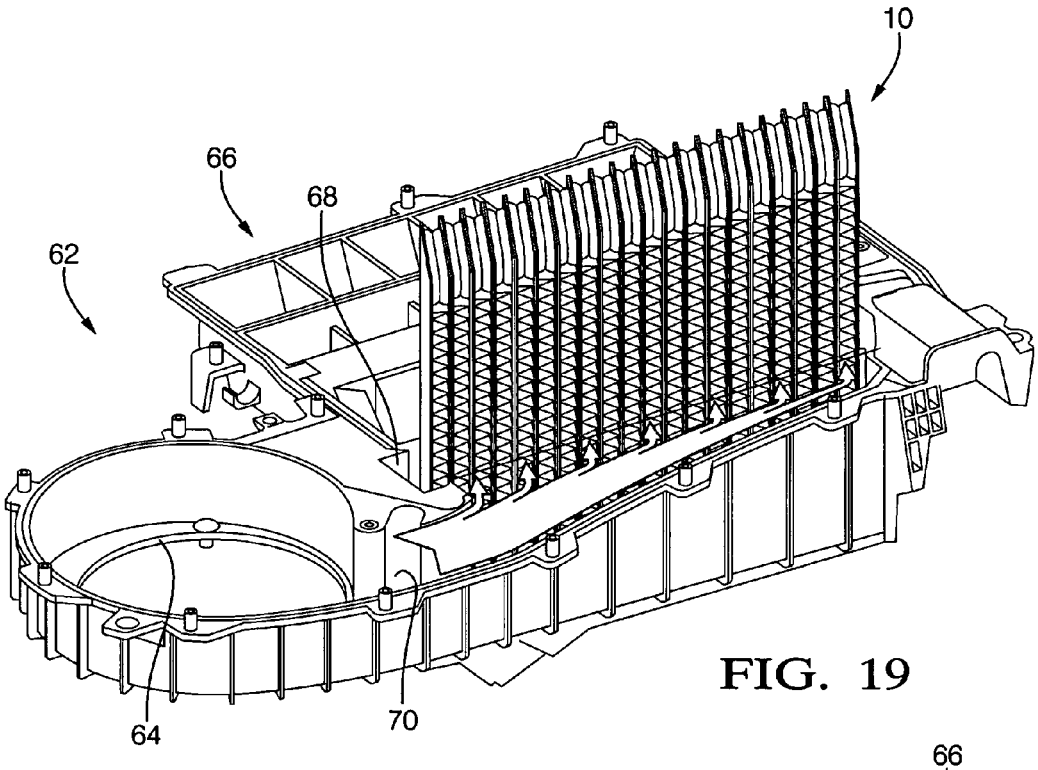
FIG. 19 is a perspective view of a portion of a climate control system for a vehicle incorporating the first exemplary embodiment of the invention.
Figure 20:
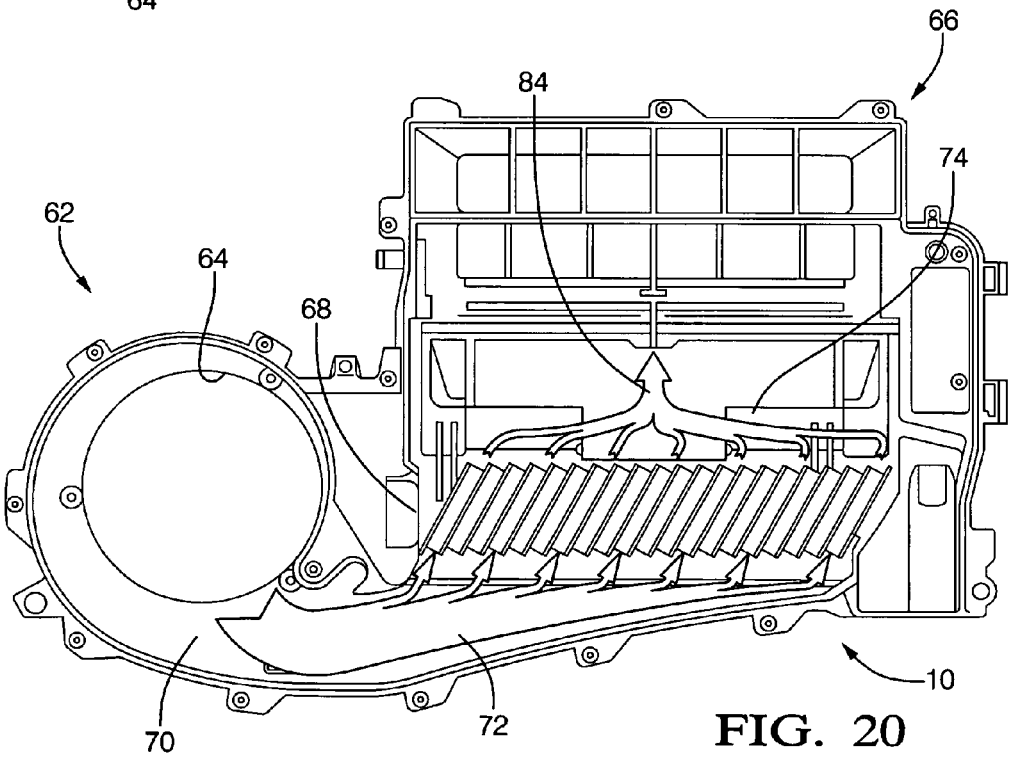
FIG. 20 is a top view of the climate control system shown in FIG. 19.

FIGS. 19-20 show one exemplary operating embodiment of the invention, a portion of a climate control system for a vehicle. A heat exchanger 10 is formed from a plurality of embossed, stacked plates, such as plates 12, 12*b* in FIGS. 1-3, and is engaged with a fluid diffuser 62. The plates of the heat exchanger 10 cooperate to form fluid passageways for refrigerant, as will be described in greater detail below. The heat exchanger 10 is an evaporator in the exemplary operating environment, however, the heat exchanger could be a condenser in other operating environments. The fluid diffuser 62 has an inlet 64 and an outlet 66. A blower can be disposed adjacent the inlet 64 to urge an air stream through the fluid diffuser 62, across the heat exchanger 10. The fluid diffuser 62 has a receiving portion 68 for receiving and substantially fixing the heat exchanger 10. A first fluid passageway 70 extends along an arcuate path 72 between the inlet 64 and the receiving portion 68 and a second fluid passageway 74 extends along a straight path 84 between the receiving portion 68 and the outlet 66. The plurality of plates are transverse to the path 84 and divert the air stream moving through the fluid diffuser 62 transverse to the second fluid passageway 74. As a result, the pressure drop across the heat exchanger 10 is reduced relative to heat exchanger having plates perpendicular to receiving and exiting cavities.

Figure 2:
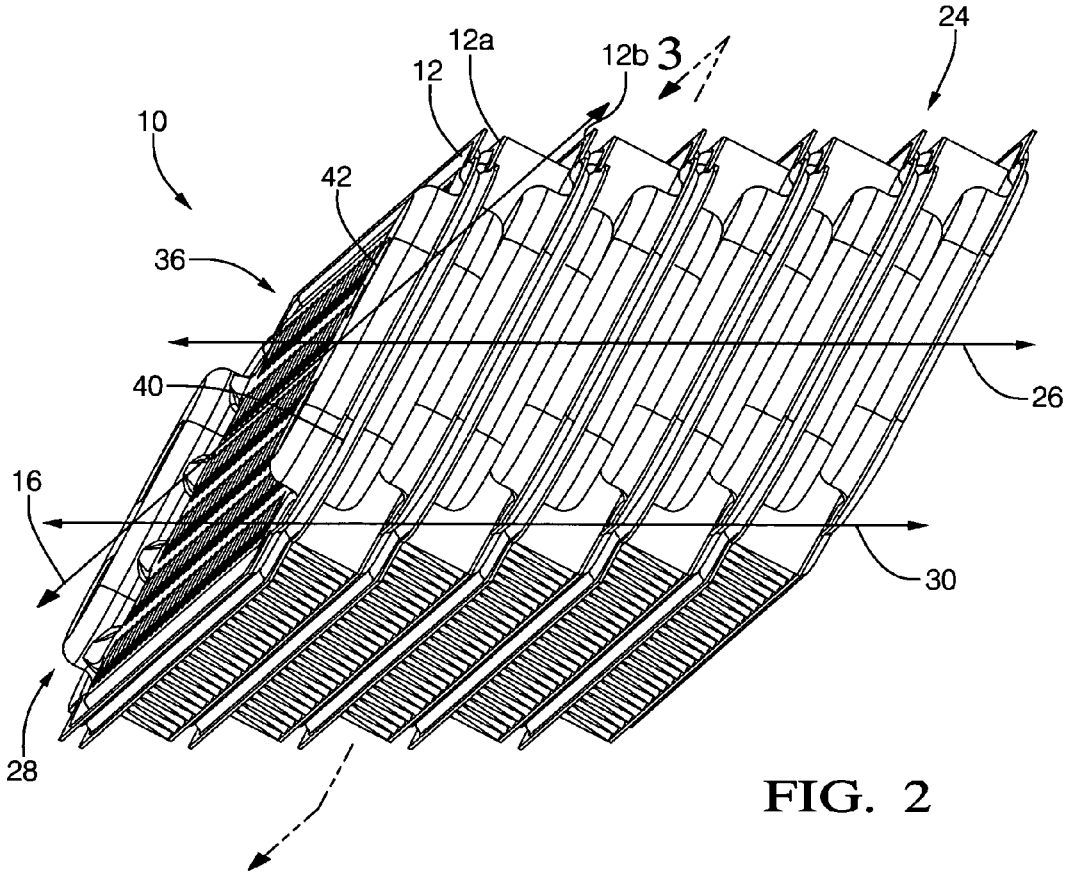
FIG. 2 is a perspective view of the first exemplary embodiment of the invention having a plurality of stacked first plates.
Figure 3:
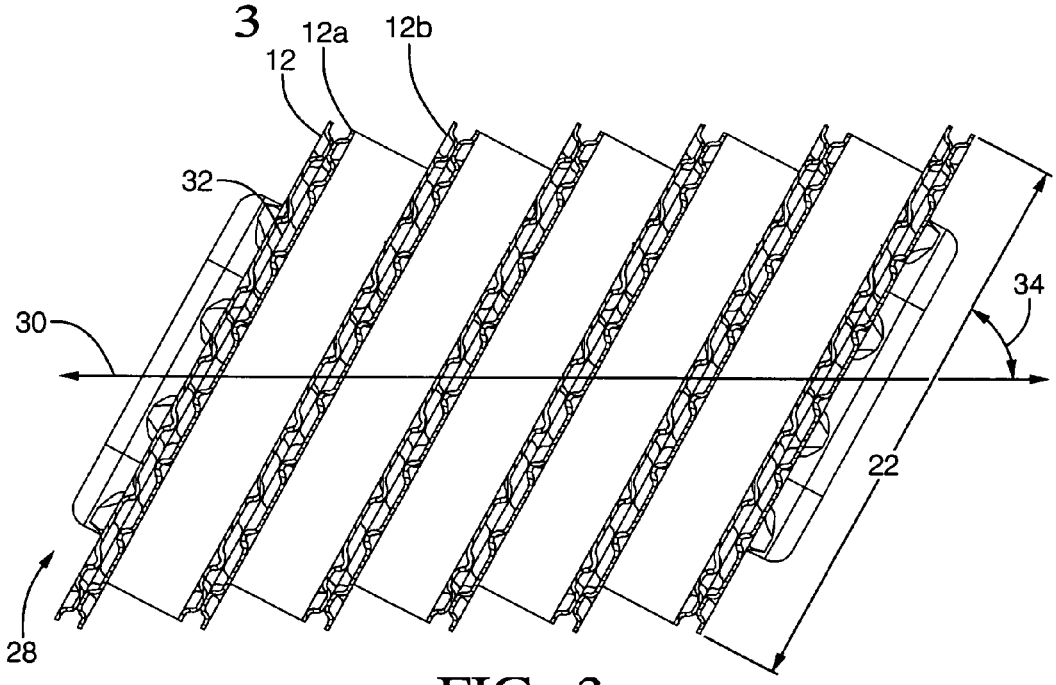
FIG. 3 is a cross-sectional view taken along section lines 3-3 in FIG. 2.

Referring now to FIGS. 1-3, in a first exemplary of the invention, the heat exchanger 10 includes the plurality of plates 12-12*b* stacked in alternating mirrored relation with one another. For example, FIG. 1 shows a plate 12 facing up. As shown in FIGS. 2 and 3, the plate 12 engages the plate 12*a* face-to-face. The plate 12*a* engages the plate 12*b* back-to-back. Each of the plurality of plates 12 has a plate length 14 extending along a plate longitudinal axis 16 between first and second ends 18, 20. As best shown in FIG. 3, each of the plurality of plates 12 also has a plate width 22 extending transverse to the plate longitudinal axis 16.

The plates 12-12*b* cooperate to define a fluid receiving cavity 24 extending along a receiving axis 26 substantially perpendicular to the plate longitudinal axis 16. FIG. 1 shows a portion of the fluid receiving cavity 24 that is defined by the single plate 12. The plates 12-12*b* also cooperate to define a fluid exiting cavity 28 extending along an exiting axis 30 substantially perpendicular to the plate longitudinal axis 16 and spaced from the receiving axis 26. FIG. 1 shows a portion of the fluid exiting cavity 28 that is defined by the single plate 12. The fluid receiving cavity 24 is disposed at the first end 20 and the fluid exiting cavity 28 is disposed at the second end 18. The plates 12 also cooperate to define a plurality of plate cavities 32 between alternating pairs of adjacent plates 12. Two plates engaged face-to-face, such as plates 12, 12*a* cooperate to define a single plate cavity 32.

Each of the plurality of plates 12-12*b* includes a substantially planar body portion 36 defining the plate length 14 and the plate width 22 and a cup portion 38 disposed at one of the first and second ends 18, 20. The cup portion 38 extends between a rim portion 40 in a first plane to a bottom portion 42 spaced from the first plane. The cup portions 38 of all of the plurality of plates 12-12*b* cooperate to define the fluid receiving cavity 24. A cup portion 76 is structured similarly as the cup portion 38 and the cup portions 76 of all of the plurality of plates 12-12*b* cooperate to define the fluid exiting cavity 28. Description of the cup portion 38 is applicable to the cup portion 76.

The plate 12 includes a lip 78 extending around the face-up surface of the planar body portion 36 and the cup portion 38 and the cup portion 76. The rim 40 is a portion of the lip 78. The lips 78 of adjacent, face-to face plates 12, 12*a* are engaged to one another to seal the interior defined between the outline of the lip 78. For example, the volume defined between bottom portions 42 of adjacent plates 12, 12*a* is a portion of the fluid receiving cavity 24. Bosses 80-80*b* extend from a surface 82; the surface 82 recessed from the lip 78. Boss 80 of the plate 12 is engaged with the boss 80*b* of the plate 12*a*.

The bottom portion 42 includes an opening portion 46 to communicate fluid to the fluid receiving cavity 24. The opening portion 24 includes first and second apertures 48, 50. In one possible mode of operation, a fluid stream can pass through apertures 48, 50 and enter the volume defined between bottom portions 42 of adjacent plates 12, 12*a*. A first portion of the fluid stream can pass through apertures 48, 50 formed in the plate 12*a*, moving in the fluid receiving cavity 24 along the receiving axis 26. A second portion of the fluid stream can pass through gaps defined between the bosses 80-80*b*, moving into the plate cavity 32 along the axis 16 towards the fluid exiting cavity 28. The plate cavities 32 extend along the plate length 14 and fluidly communicate with both of the receiving and exiting cavities 24, 28. The first exemplary embodiment is a single pass heat exchanger, however alternative embodiments of the invention can be a multi-pass heat exchanger. A single pass heat exchanger involves refrigerant moving across the heat exchanger once and a multi-pass heat exchanger involves refrigerant moving across the heat exchanger more than once.

The plate width 22 is disposed at an angle 34 less than ninety degrees relative to both of the receiving and exiting axis 26, 30. The receiving and exiting axis 26, 30 are coplanar. The angle 34 can be selected in view of the operating environment of the heat exchanger 10 such that the body portions 36 are substantially incident with fluid flow external to the heat exchanger. This can be desirable to reduce external fluid flow pressure drop across the heat exchanger 10. Also, the angle 34 can be selected in view of the desired orientation of the receiving and exiting axis 26, 30.

In the first exemplary embodiment of the invention, the plate width 22 can be disposed at an angle 34 less than ninety degrees relative to both of the receiving and exiting axis 26, 30 by shifting the positions of the apertures 48, 50. The rim portion 40 is disposed in the first plane substantially parallel to the body portion 36. The bottom portion 42 extends in a second plane substantially parallel to the body portion 36. A cup longitudinal axis 44 extends between the rim portion 40 and the bottom portion 42 perpendicular to the plate longitudinal axis 16. The opening portion 46 is centered on a point spaced from the cup longitudinal axis 44. In other words, the first and second apertures 48, 50 have respective first and second centers 52, 54. One of the first and second centers 52, 54 is closer to the cup longitudinal axis 44 than the other of the first and second centers 52, 54. As result, when plates 12*a*, 12*b* are engaged in back-to-back relation, as shown in FIG. 2, the aperture 48 of plate 12*a* will be aligned with aperture 50 of plate 12*b* and the aperture 50 of plate 12*a* will be aligned with aperture 48 of plate 12*b*.

Figure 4:
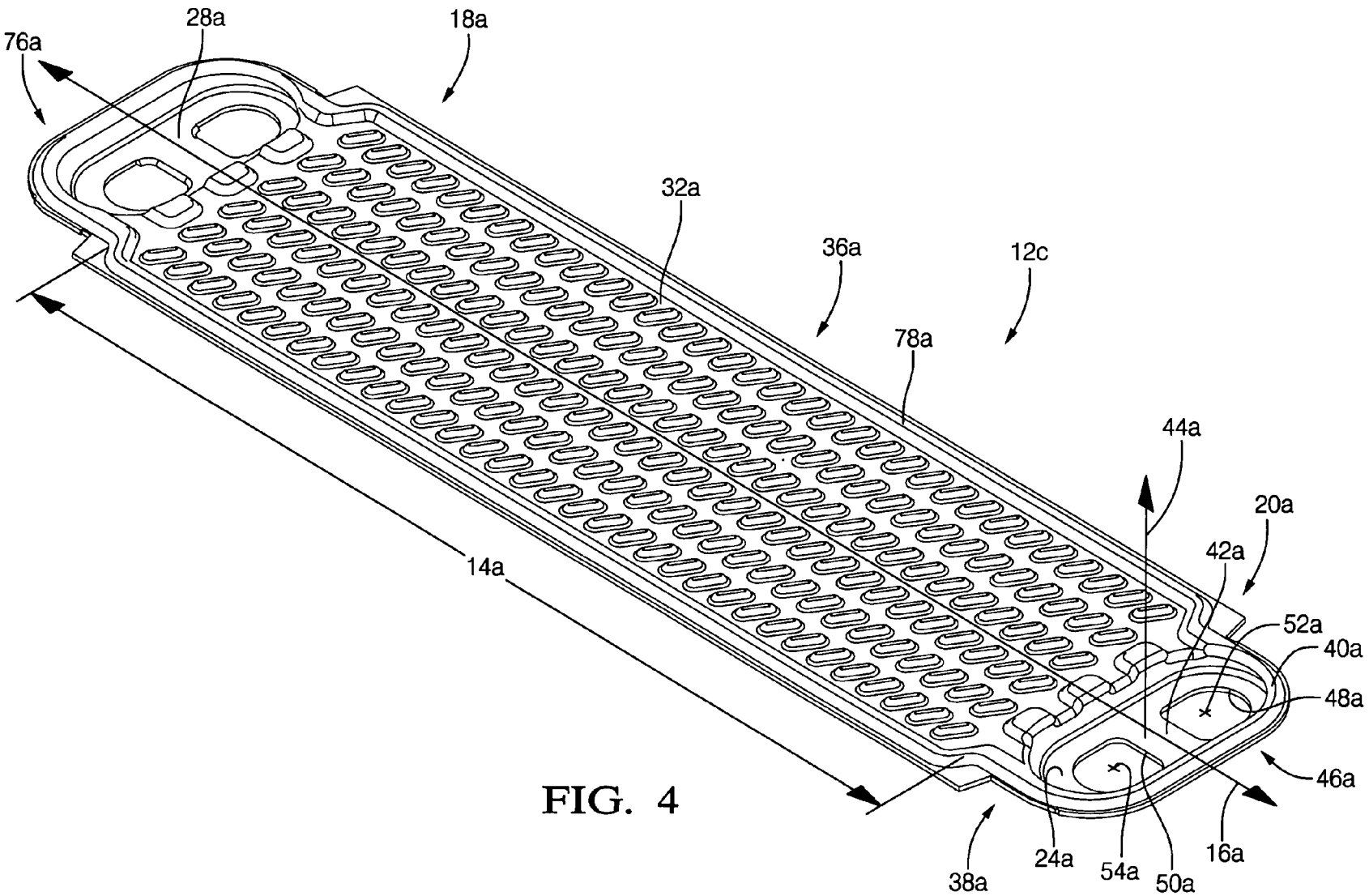
FIG. 4 is a perspective view of a second plate according to a second exemplary embodiment of the invention.
Figure 5:
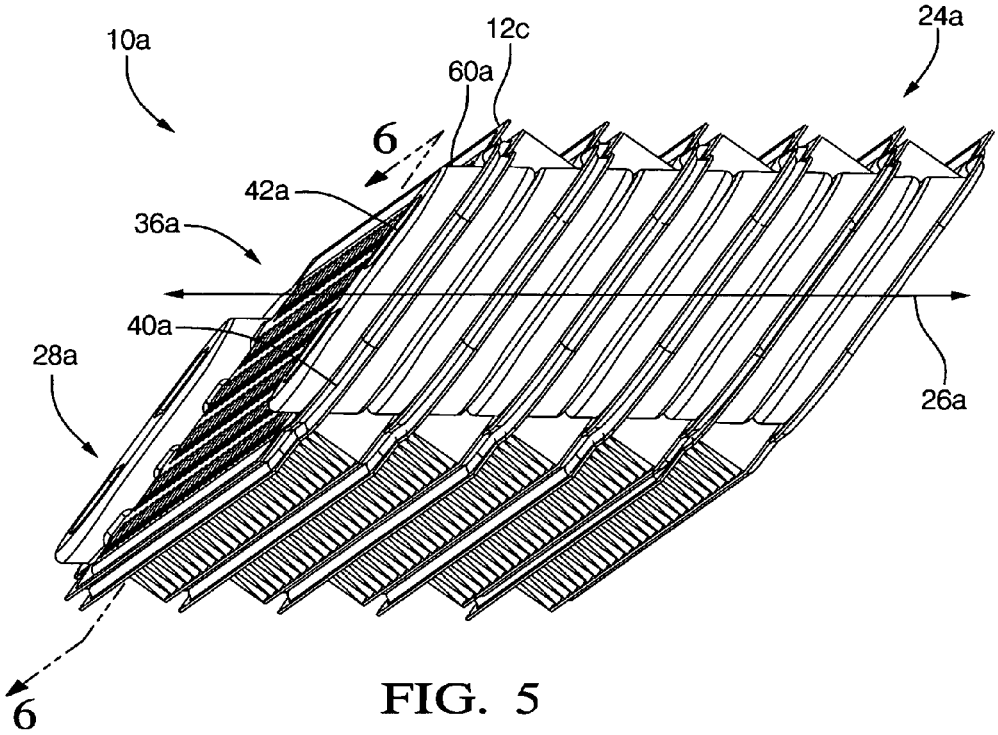
FIG. 5 is a perspective view of the second exemplary embodiment of the invention having a plurality of stacked second plates.
Figure 6:
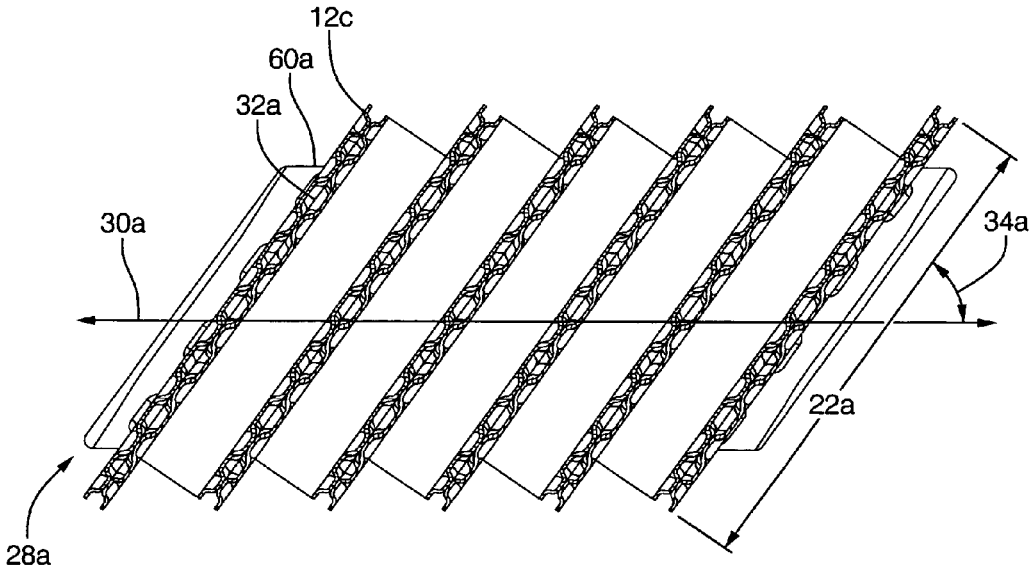
FIG. 6 is a cross-sectional view taken along section lines 6-6 in FIG. 5.

Referring now to FIGS. 4-6, in a second exemplary of the invention, a heat exchanger 10*a* includes a plurality of plates 12*c* stacked in alternating mirrored relation with one another, similar to the plates 12-12*b* of FIGS. 1-3. Each of the plurality of plates 12*c* has a plate length 14*a* extending along a plate longitudinal axis 16*a* between first and second ends 18*a*, 20*a*. As best shown in FIG. 6, each of the plurality of plates 12*c* also has a plate width 22*a* extending transverse to the plate longitudinal axis 16*a*.

The plates 12*c* cooperate to define a fluid receiving cavity 24*a* extending along a receiving axis 26*a* substantially perpendicular to the plate longitudinal axis 16*a*. FIG. 4 shows a portion of the fluid receiving cavity 24*a* that is defined by the single plate 12*c*. The plates 12*c* also cooperate to define a fluid exiting cavity 28*a* extending along an exiting axis 30*a* substantially perpendicular to the plate longitudinal axis 16*a* and spaced from the receiving axis 26*a*. FIG. 4 shows a portion of the fluid exiting cavity 28*a* that is defined by the single plate 12*c*. The fluid receiving cavity 24*a* is disposed at the first end 20*a* and the fluid exiting cavity 28*a* is disposed at the second end 18*a*. The plates 12*c* also cooperate to define a plurality of plate cavities 32*a* between alternating pairs of adjacent plates 12*c*. Two plates 12*c* engaged face-to-face cooperate to define a single plate cavity 32*a*.

Each of the plurality of plates 12*c* includes a substantially planar body portion 36*a* defining the plate length 14*a* and the plate width 22*a* and a cup portion 38*a* disposed at one of the first and second ends 18*a*, 20*a*. The cup portion 38*a* extends between a rim portion 40*a* in a first plane to a bottom portion 42*a* spaced from the first plane. The cup portions 38*a* of all of the plurality of plates 12*c* cooperate to define the fluid receiving cavity 24*a*. A cup portion 76*a* is structured similarly as the cup portion 38*a* and the cup portions 76*a* of all of the plurality of plates 12*c* cooperate to define the fluid exiting cavity 28*a*. Description of the cup portion 38*a* is applicable to the cup portion 76*a*.

The plate 12*c* includes a lip 78*a* extending around the face-up surface of the planar body portion 36*a* and the cup portion 38*a* and the cup portion 76*a*. The rim 40*a* is a portion of the lip 78*a*. The lips 78*a* of adjacent, face-to face plates 12*c* are engaged to one another to seal the interior defined between the outline of the lip 78*a*. For example, the volume defined between bottom portions 42*a* of adjacent plates 12*c* is a portion of the fluid receiving cavity 24*a*. Bosses extend from a surface recessed from the lip 78*a*.

The bottom portion 42*a* includes an opening portion 46*a* to communicate fluid to the fluid receiving cavity 24*a*. The opening portion 24*a* includes first and second apertures 48*a*, 50*a*. In one possible mode of operation, a fluid stream can pass through apertures 48*a*, 50*a* and enter the volume defined between bottom portions 42*a* of adjacent plates 12*c*. A first portion of the fluid stream can pass through apertures 48*a*, 50*a* of a first plate 12*c*, the volume defined between bottom portions 42*a*, and further through apertures 48*a*, 50*a* formed in a second plate 12*c* to move in the fluid receiving cavity 24*a* along the receiving axis 26*a*. A second portion of the fluid stream can pass through gaps defined between the bosses, moving into the plate cavity 32*a* along the axis 16*a* towards the fluid exiting cavity 28*a*. The plate cavities 32*a* extend along the plate length 14*a* and fluidly communicate with both of the receiving and exiting cavities 24*a*, 28*a*. The second exemplary embodiment is a single pass heat exchanger, however alternative embodiments of the invention can be a multi-pass heat exchanger.

The plate width 22*a* is disposed at an angle 34*a* less than ninety degrees relative to both of the receiving and exiting axis 26*a*, 30*a*. The receiving and exiting axis 26*a*, 30*a* are coplanar. The angle 34*a* can be selected in view of the operating environment of the heat exchanger 10*a* such that the body portions 36*a* are substantially incident with fluid flow external to the heat exchanger. This can be desirable to reduce external fluid flow pressure drop across the heat exchanger 10*a*. Also, the angle 34*a* can be selected in view of the desired orientation of the receiving and exiting axis 26*a*, 30*a*.

In the second exemplary of the invention, the plate width 22*a* can be disposed at an angle 34*a* less than ninety degrees relative to both of the receiving and exiting axis 26*a*, 30*a* by shifting the positions of the apertures 48*a*, 50*a*. The rim portion 40*a* is disposed in the first plane substantially parallel to the body portion 36*a*. The bottom portion 42*a* extends in a second plane substantially parallel to the body portion 36*a*. A cup longitudinal axis 44*a* extends between the rim portion 40*a* and the bottom portion 42*a* perpendicular to the plate longitudinal axis 16*a*. The opening portion 46*a* is centered on a point spaced from the cup longitudinal axis 44*a*. In other words, the first and second apertures 48*a*, 50*a* have respective first and second centers 52*a*, 54*a*. One of the first and second centers 52*a*, 54*a* is closer to the cup longitudinal axis 44*a* than the other of the first and second centers 52*a*, 54*a*. As result, when first and second plates 12*c* are engaged in back-to-back relation the aperture 48*a* of a first plate 12*c* will be aligned with aperture 50*a* of a second plate 12*c*. At least one structural difference between the first and second embodiments is the shape of the cup portions 38 and 38*a*. The cup portion 38 is substantially symmetrical about the axis 44. The cup portion 38*a* extends transverse to the axis 44*a* and, as result, defines an outer surface 60*a* extending around and parallel to the axis 26*a*. The surface 60*a* can be desirable for mounting or locating the heat exchanger 10*a* in a fluid diffuser.

Figure 7:
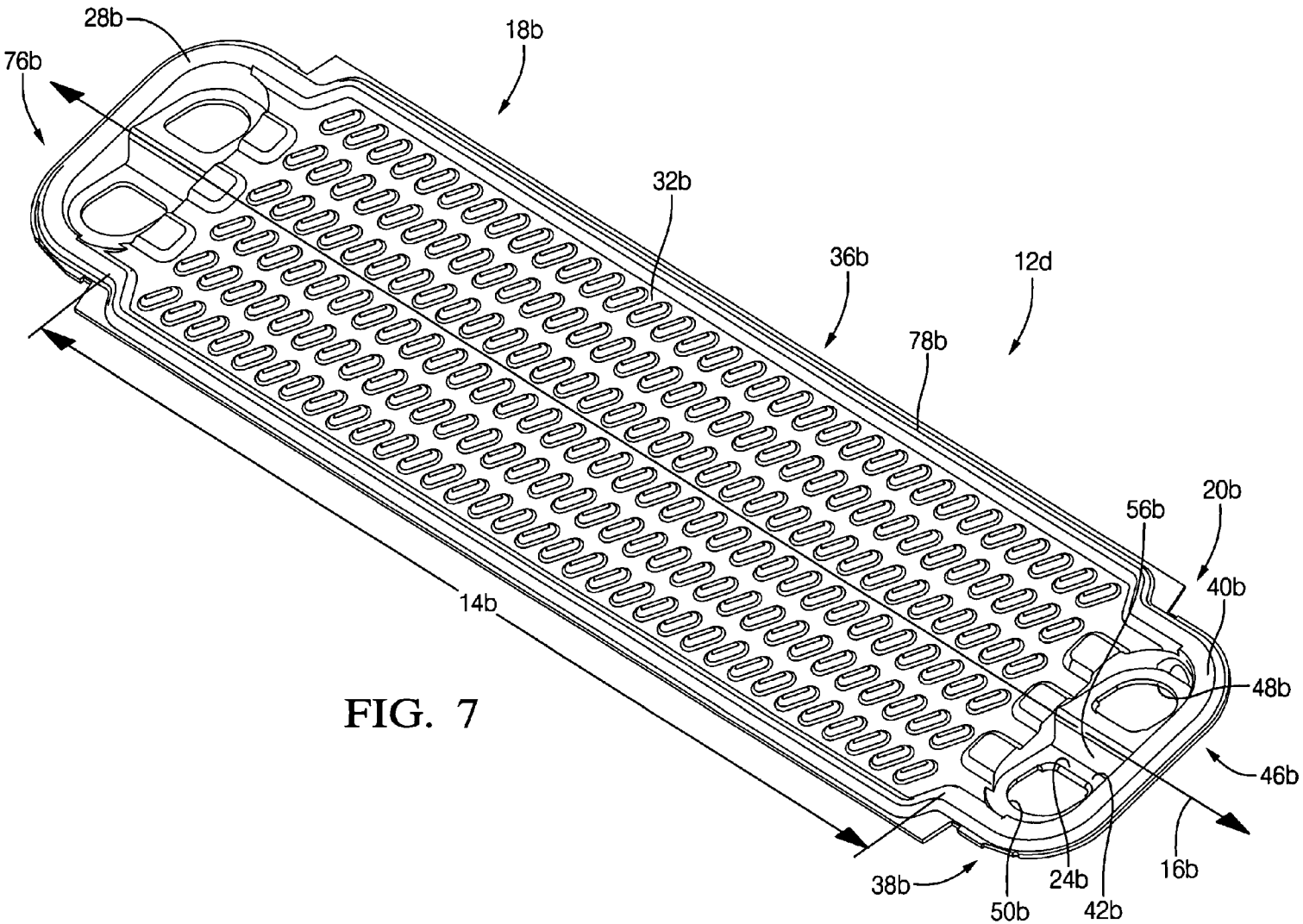
FIG. 7 is a perspective view of a third plate according to a third exemplary embodiment of the invention.
Figure 8:
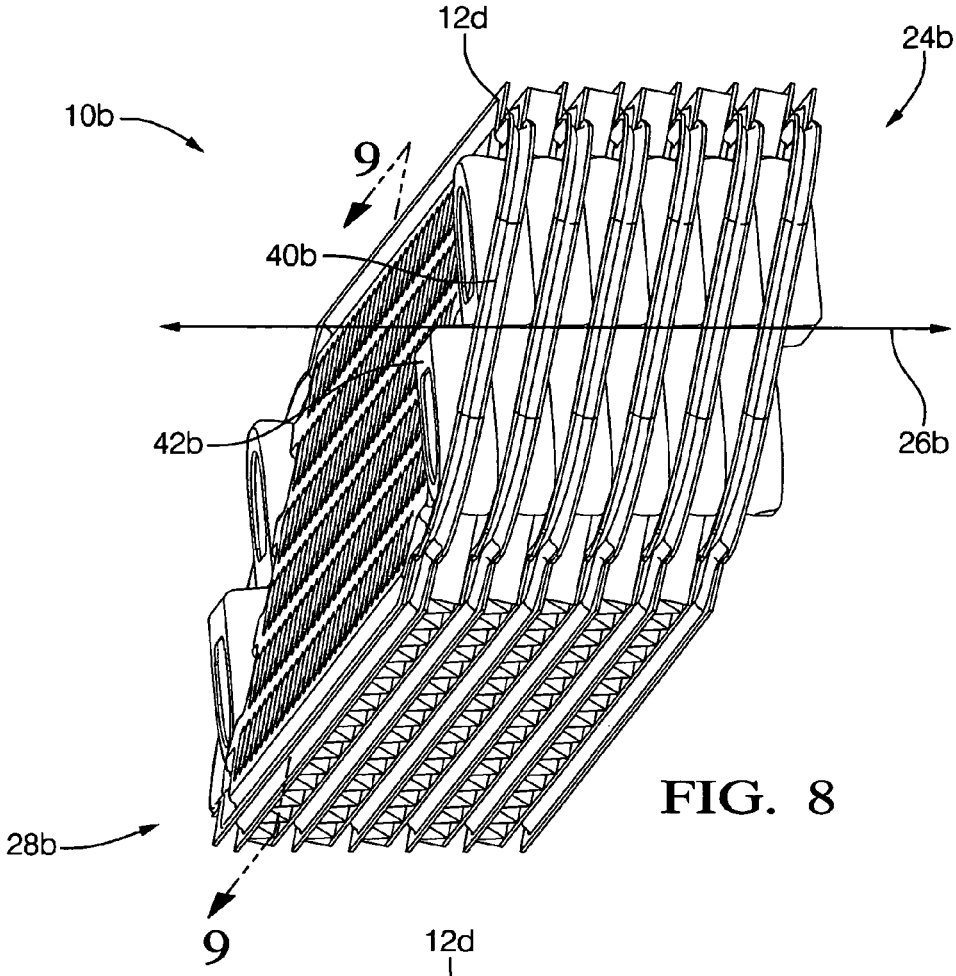
FIG. 8 is a perspective view of the third exemplary embodiment of the invention having a plurality of stacked third plates.
Figure 9:
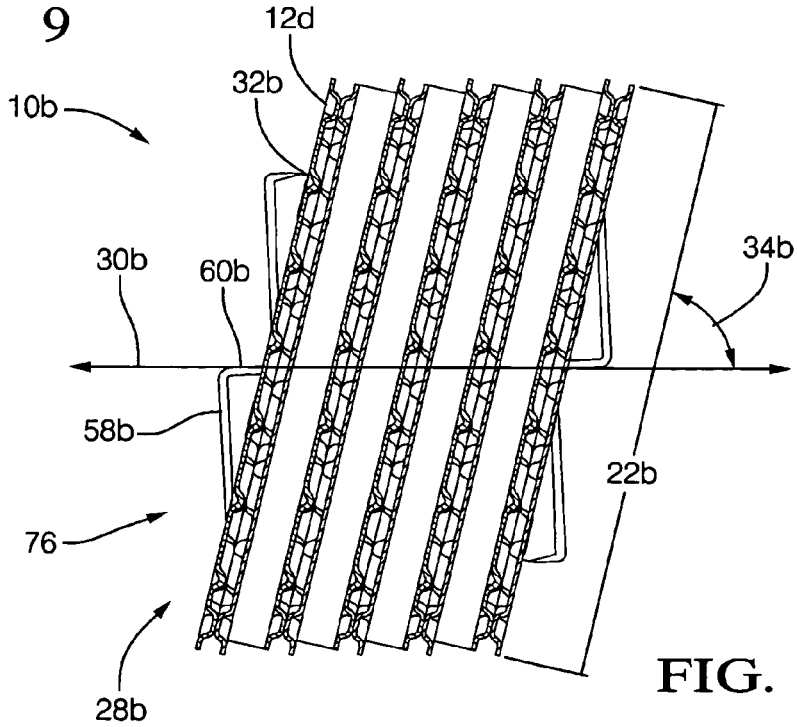
FIG. 9 is a cross-sectional view taken along section lines 9-9 in FIG. 8.

Referring now to FIGS. 7-9, in a third exemplary of the invention, a heat exchanger 10*b* includes a plurality of plates 12*d* stacked in alternating mirrored relation with one another, similar to the plates 12-12*b* of FIGS. 1-3. Each of the plurality of plates 12*d* has a plate length 14*b* extending along a plate longitudinal axis 16*b* between first and second ends 18*b*, 20*b*. As best shown in FIG. 9, each of the plurality of plates 12*d* also has a plate width 22*b* extending transverse to the plate longitudinal axis 16*b*.

The plates 12*d* cooperate to define a fluid receiving cavity 24*b* extending along a receiving axis 26*b* substantially perpendicular to the plate longitudinal axis 16*b*. FIG. 7 shows a portion of the fluid receiving cavity 24*b* that is defined by the single plate 12*d*. The plates 12*d* also cooperate to define a fluid exiting cavity 28*b* extending along an exiting axis 30*b* substantially perpendicular to the plate longitudinal axis 16*b* and spaced from the receiving axis 26*b*. FIG. 7 shows a portion of the fluid exiting cavity 28*b* that is defined by the single plate 12*d*. The fluid receiving cavity 24*b* is disposed at the first end 20*b* and the fluid exiting cavity 28*b* is disposed at the second end 18*b*. The plates 12*d* also cooperate to define a plurality of plate cavities 32*b* between alternating pairs of adjacent plates 12*d*. Two plates 12*d* engaged face-to-face cooperate to define a single plate cavity 32*b*.

Each of the plurality of plates 12*d* includes a substantially planar body portion 36*b* defining the plate length 14*b*and the plate width 22*b* and a cup portion 38*b* disposed at one of the first and second ends 18*b*, 20*b*. The cup portion 38*b* extends between a rim portion 40*b* in a first plane to a bottom portion 42*b* spaced from the first plane. The cup portions 38*b* of all of the plurality of plates 12*d* cooperate to define the fluid receiving cavity 24*b*. A cup portion 76*b* is structured similarly as the cup portion 38*b* and the cup portions 76*b* of all of the plurality of plates 12*d* cooperate to define the fluid exiting cavity 28*b*. Description of the cup portion 38*b* is applicable to the cup portion 76*b*.

The plate 12*d* includes a lip 78*b* extending around the face-up surface of the planar body portion 36*b* and the cup portion 38*b* and the cup portion 76*b*. The rim 40*b* is a portion of the lip 78*b*. The lips 78*b* of adjacent, face-to face plates 12*d* are engaged to one another to seal the interior defined between the outline of the lip 78*b*. For example, the volume defined between bottom portions 42*b* of adjacent plates 12*d* is a portion of the fluid receiving cavity 24*b*. Bosses extend from a surface recessed from the lip 78*b*.

The bottom portion 42*b* includes an opening portion 46*b* to communicate fluid to the fluid receiving cavity 24*b*. The opening portion 24*b* includes first and second apertures 48*b*,

50*b*. In one possible mode of operation, a fluid stream can pass through apertures 48*b*, 50*b* and enter the volume defined between bottom portions 42*b* of adjacent plates 12*d*. A first portion of the fluid stream can pass through apertures 48*b*, 50*b* of a first plate 12*d*, the volume defined between bottom portions 42*b*, and further through apertures 48*b*, 50*b* formed in a second plate 12*d* to move in the fluid receiving cavity 24*b* along the receiving axis 26*b*. A second portion of the fluid stream can pass through gaps defined between the bosses, moving into the plate cavity 32*b* along the axis 16*b* towards the fluid exiting cavity 28*b*. The plate cavities 32*b* extend along the plate length 14*b* and fluidly communicate with both of the receiving and exiting cavities 24*b*, 28*b*. The third exemplary embodiment is a single pass heat exchanger, however alternative embodiments of the invention can be a multi-pass heat exchanger.

The plate width 22*b* is disposed at an angle 34*b* less than ninety degrees relative to both of the receiving and exiting axis 26*b*, 30*b*. The receiving and exiting axis 26*b*, 30*b* are coplanar. The angle 34*b* can be selected in view of the operating environment of the heat exchanger 10*b* such that the body portions 36*b* are substantially incident with fluid flow external to the heat exchanger. This can be desirable to reduce external fluid flow pressure drop across the heat exchanger 10*b*. Also, the angle 34*b* can be selected in view of the desired orientation of the receiving and exiting axis 26*b*, 30*b*.

In the third exemplary of the invention, the plate width 22*b* can be disposed at an angle 34*b* less than ninety degrees relative to both of the receiving and exiting axis 26*b*, 30*b* by disposing the apertures 48*b* and 50*b* in one or more planes transverse to the body portion 36*b*. The body portion 36*b* and the rim portion 40*b*, disposed in the first plane, are substantially parallel to one another. The bottom portion 42*b* extends in second and third planes parallel and spaced from one another. The aperture 48*b* is defined in the second plane and the aperture 50*b* is disposed in the third plane. Both of the second and third planes are transverse to body portion 36*b*, as best shown in FIG. 7. The apertures 48*b*, 50*b* are centered with respect to the axis 16*b*. Where first and second plates 12*d* are engaged back-to back, the aperture 48*b* of a first plate 12*d* will engage the aperture 50*b* of the second plate 12*d*. A transition portion 56*b* extends between the second and third planes perpendicular to the plate longitudinal axis 16*b*. The bottom portion 42*b* includes a first outer surface 58*b* extending perpendicular to the receiving axis 26*b* and a second outer surface 60*b* adjacent to the first outer surface 58*b* and extending parallel to the receiving axis 26*b*. The surfaces 58*b*, 60*b* can be desirable for mounting or locating the heat exchanger 10*b* in a fluid diffuser.

The surfaces 58*b*, 60*b* are indicated with respect to the cup portion 76*b* based on the selected cross-section shown in FIG. 9. However, as set forth above the cup portions 38*b* and 76*b* are structured similarly. Relative to the appearance of the cup portion 76*b*, the cross-sectional view of FIG. 9 is identical to the appearance of the cup portion 38*b* as would be shown in a front view looking from the axis 26*b* towards the axis 30*b*. A similar drawing arrangement has been made in the other exemplary embodiments of the invention described below.

Figure 10:
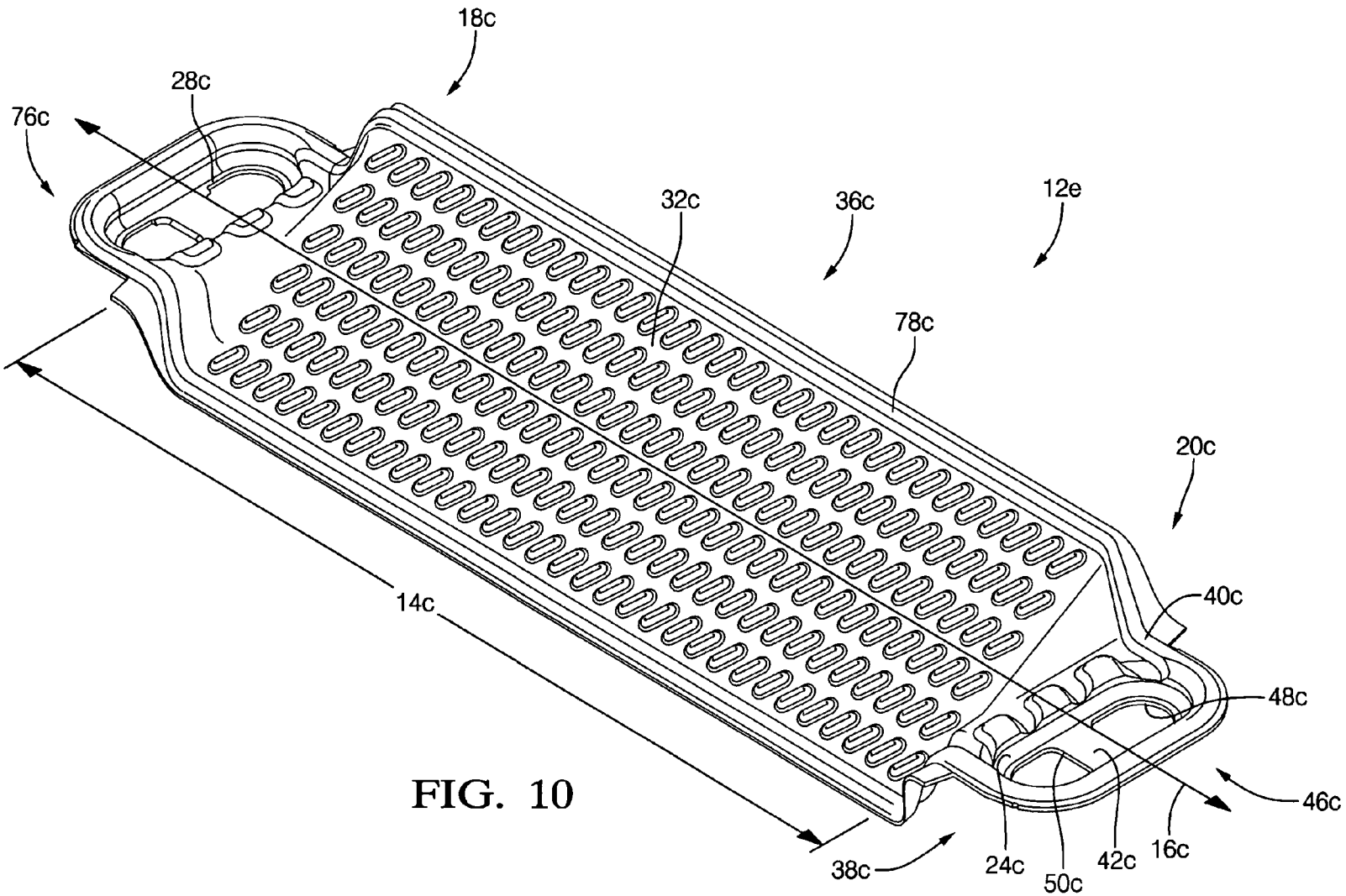
FIG. 10 is a perspective view of a fourth plate according to a fourth exemplary embodiment of the invention.
Figure 11:
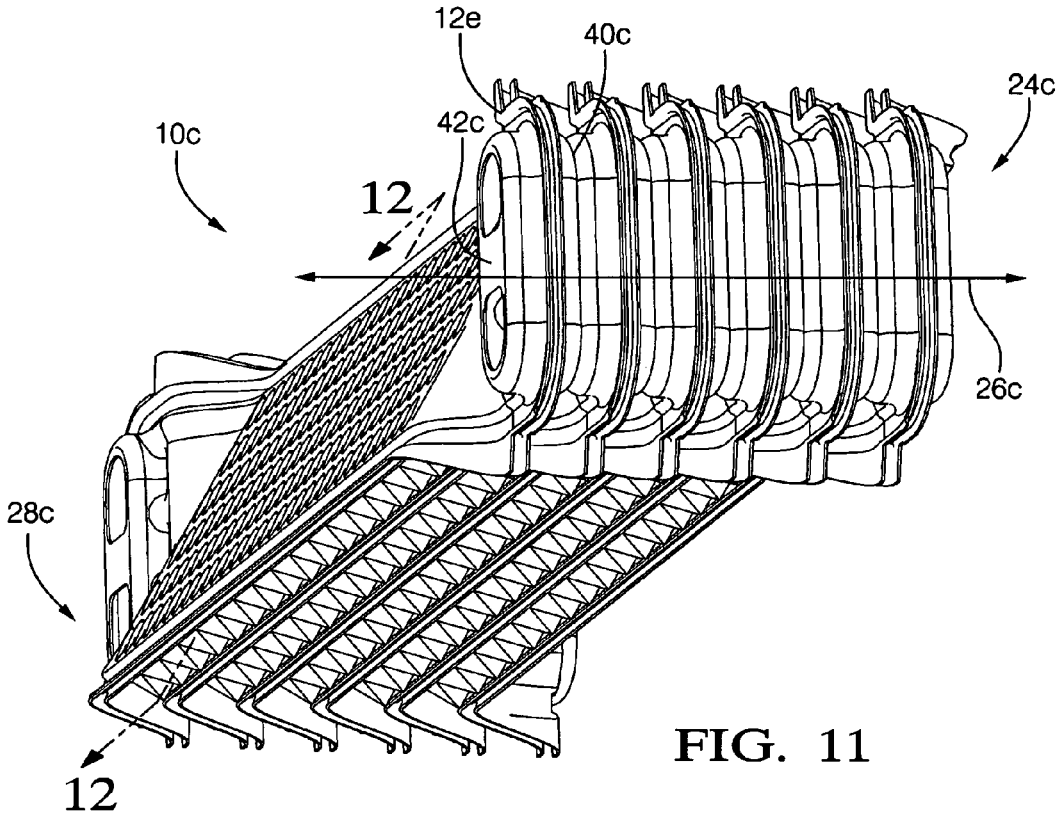
FIG. 11 is a perspective view of the fourth exemplary embodiment of the invention having a plurality of stacked fourth plates.
Figure 12:
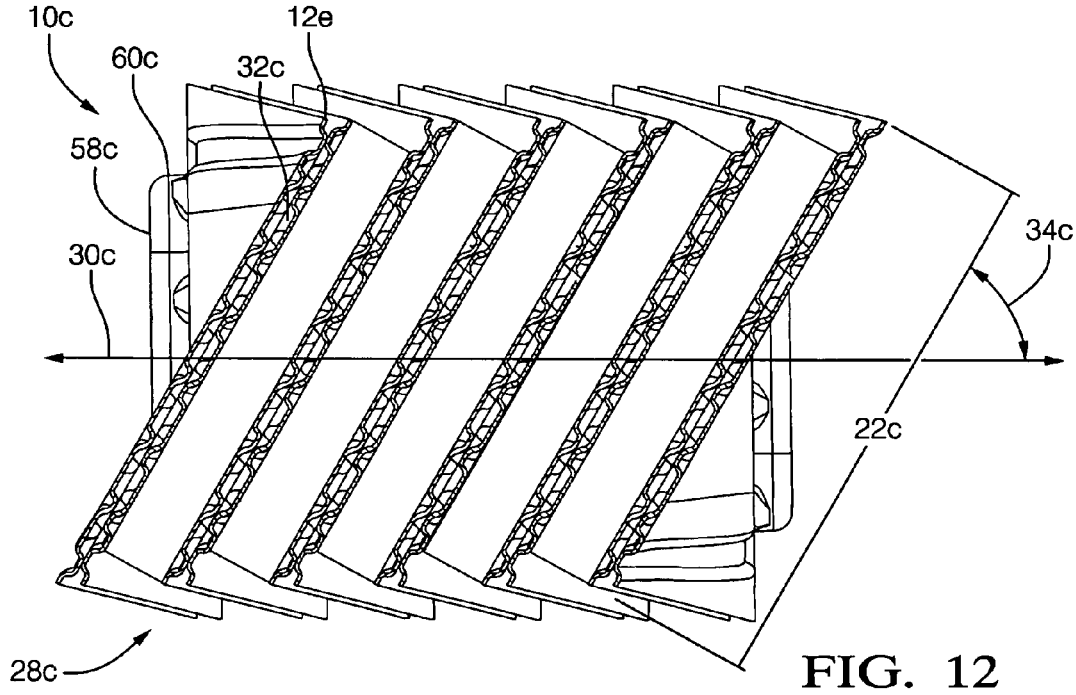
FIG. 12 is a cross-sectional view taken along section lines 12-12 in FIG. 11.

Referring now to FIGS. 10-12, in a fourth exemplary of the invention, a heat exchanger 10*c* includes a plurality of plates 12*e* stacked in alternating mirrored relation with one another, similar to the plates 12-12*b* of FIGS. 1-3. Each of the plurality of plates 12*e* has a plate length 14*c* extending along a plate longitudinal axis 16*c* between first and second ends 18*c*, 28*c*. As best shown in FIG. 12, each of the plurality of plates 12*e* also has a plate width 22*c* extending transverse to the plate longitudinal axis 16*c*.

The plates 12*e* cooperate to define a fluid receiving cavity 24*c* extending along a receiving axis 26*c* substantially perpendicular to the plate longitudinal axis 16*c*. FIG. 10 shows a portion of the fluid receiving cavity 24*c* that is defined by the single plate 12*e*. The plates 12*e* also cooperate to define a fluid exiting cavity 28*c* extending along an exiting axis 30*c* substantially perpendicular to the plate longitudinal axis 16*c* and spaced from the receiving axis 26*c*. FIG. 10 shows a portion of the fluid exiting cavity 28*c* that is defined by the single plate 12*e*. The fluid receiving cavity 24*c* is disposed at the first end 20*c* and the fluid exiting cavity 28*c* is disposed at the second end 18*c*. The plates 12*e* also cooperate to define a plurality of plate cavities 32*c* between alternating pairs of adjacent plates 12*e*. Two plates 12*e* engaged face-to-face cooperate to define a single plate cavity 32*c*.

Each of the plurality of plates 12*e* includes a substantially planar body portion 36*c* defining the plate length 14*c* and the plate width 22*c* and a cup portion 38*c* disposed at one of the first and second ends 18*c*, 20*c*. The cup portion 38*c* extends between a rim portion 40*c* in a first plane to a bottom portion 42*c* spaced from the first plane. The cup portions 38*c* of all of the plurality of plates 12*e* cooperate to define the fluid receiving cavity 24*c*. A cup portion 76*c* is structured similarly as the cup portion 38*c* and the cup portions 76*c* of all of the plurality of plates 12*e* cooperate to define the fluid exiting cavity 28*c*. Description of the cup portion 38*c* is applicable to the cup portion 76*c*.

The plate 12*e* includes a lip 78*c* extending around the face-up surface of the planar body portion 36*c* and the cup portion 38*c* and the cup portion 76*c*. The rim 40*c* is a portion of the lip 78*c*. The lips 78*c* of adjacent, face-to face plates 12*e* are engaged to one another to seal the interior defined between the outline of the lip 78*c*. For example, the volume defined between bottom portions 42*c* of adjacent plates 12*e* is a portion of the fluid receiving cavity 24*c*. Bosses extend from a surface recessed from the lip 78*c*.

The bottom portion 42*c* includes an opening portion 46*c* to communicate fluid to the fluid receiving cavity 24*c*. The opening portion 24*c* includes first and second apertures 48*c*, 50*c*. In one possible mode of operation, a fluid stream can pass through apertures 48*c*, 50*c* and enter the volume defined between bottom portions 42*c* of adjacent plates 12*e*. A first portion of the fluid stream can pass through apertures 48*c*, 50*c* of a first plate 12*e*, the volume defined between bottom portions 42*c*, and further through apertures 48*c*, 50*c* formed in a second plate 12*e* to move in the fluid receiving cavity 24*c* along the receiving axis 26*c*. A second portion of the fluid stream can pass through gaps defined between the bosses, moving into the plate cavity 32*c* along the axis 16*c* towards the fluid exiting cavity 28*c*. The plate cavities 32*c* extend along the plate length 14*c* and fluidly communicate with both of the receiving and exiting cavities 24*c*, 28*c*. The fourth exemplary embodiment is a single pass heat exchanger, however alternative embodiments of the invention can be a multi-pass heat exchanger.

The plate width 22*c* is disposed at an angle 34*c* less than ninety degrees relative to both of the receiving and exiting axis 26*c*, 30*c*. The receiving and exiting axis 26*c*, 30*c* are coplanar. The angle 34*c* can be selected in view of the operating environment of the heat exchanger 10*c* such that the body portions 36*c* are substantially incident with fluid flow external to the heat exchanger. This can be desirable to reduce external fluid flow pressure drop across the heat exchanger 10*c*. Also, the angle 34*c* can be selected in view of the desired orientation of the receiving and exiting axis 26*c*, 30*c*.

In the fourth exemplary of the invention, the plate width 22*c* can be disposed at an angle 34*c* less than ninety degrees relative to both of the receiving and exiting axis 26*c*, 30*c* by twisting, or rotating, the body portion 36*c* and the cup portion 38*c* relative to one another. The body portion 36*c* and the rim portion 40*c*, disposed in the first plane, are transverse to one another. The bottom portion 42*c* extends in a second plane substantially parallel to the first plane. The opening portion 46*c*, with apertures 48*c*, 50*c* is centered in the cup portion 38*c*. Where first and second plates 12*e* are engaged back-to back, the aperture 48*c* of a first plate 12*e* will engage the aperture 50*c* of the second plate 12*e*. The bottom portion 42*c* includes a first outer surface 58*c* extending perpendicular to the receiving axis 26*c* and a second outer surface 60*c* adjacent to the first outer surface 58*c* and extending parallel to the receiving axis 26*c*. The surfaces 58*c*, 60*c* can be desirable for mounting or locating the heat exchanger 10*c* in a fluid diffuser.

Figure 13:
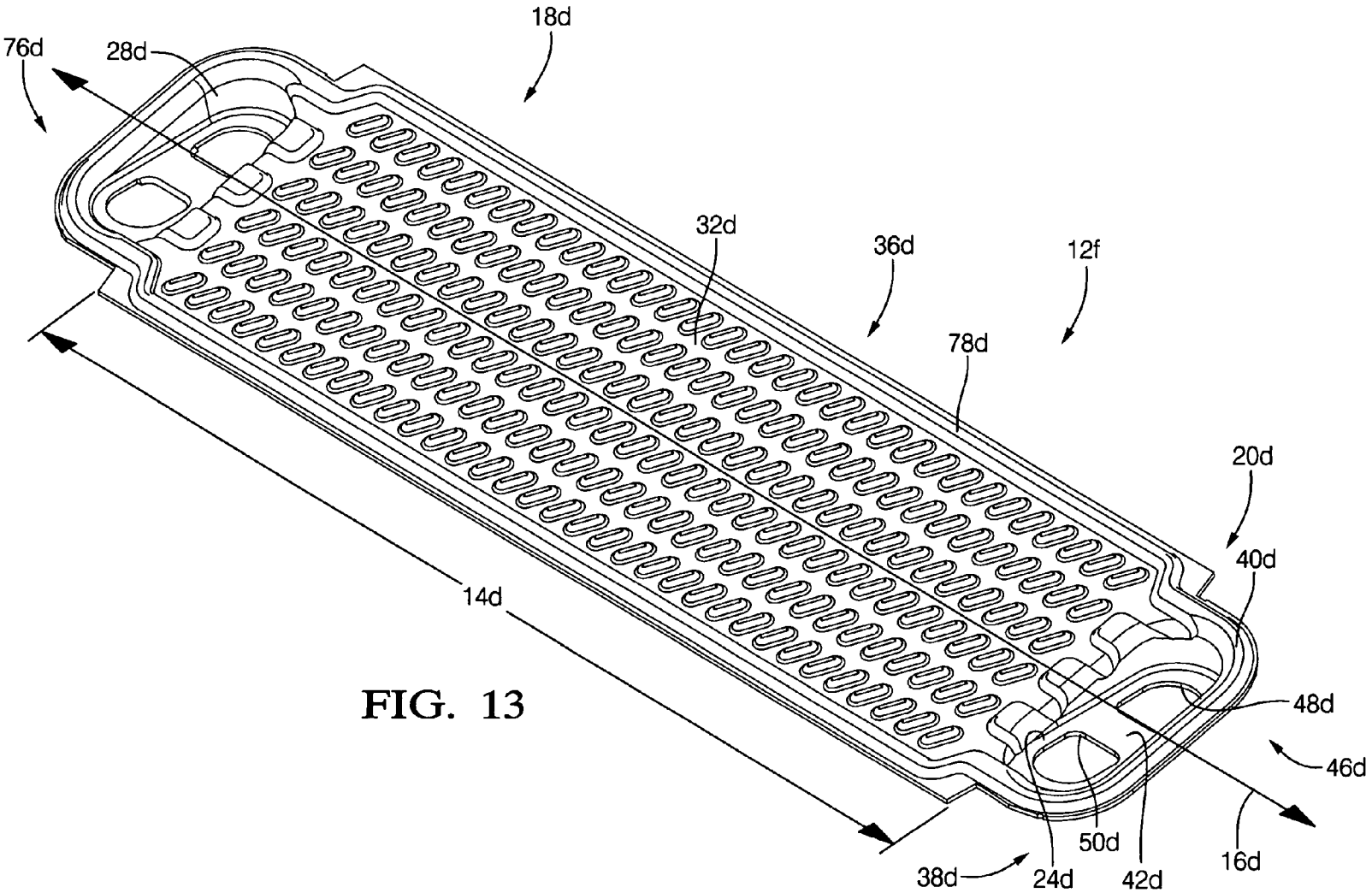
FIG. 13 is a perspective view of a fifth plate according to a fifth exemplary embodiment of the invention.
Figure 14:
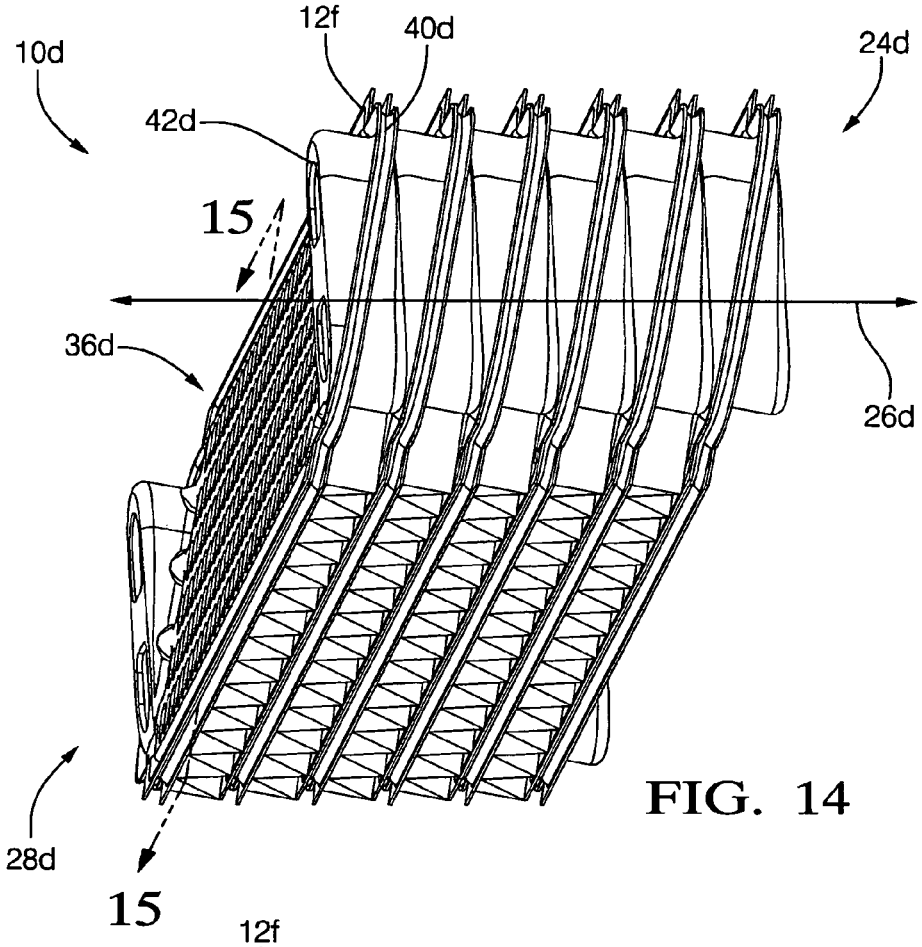
FIG. 14 is a perspective view of the fifth exemplary embodiment of the invention having a plurality of stacked fifth plates.
Figure 15:
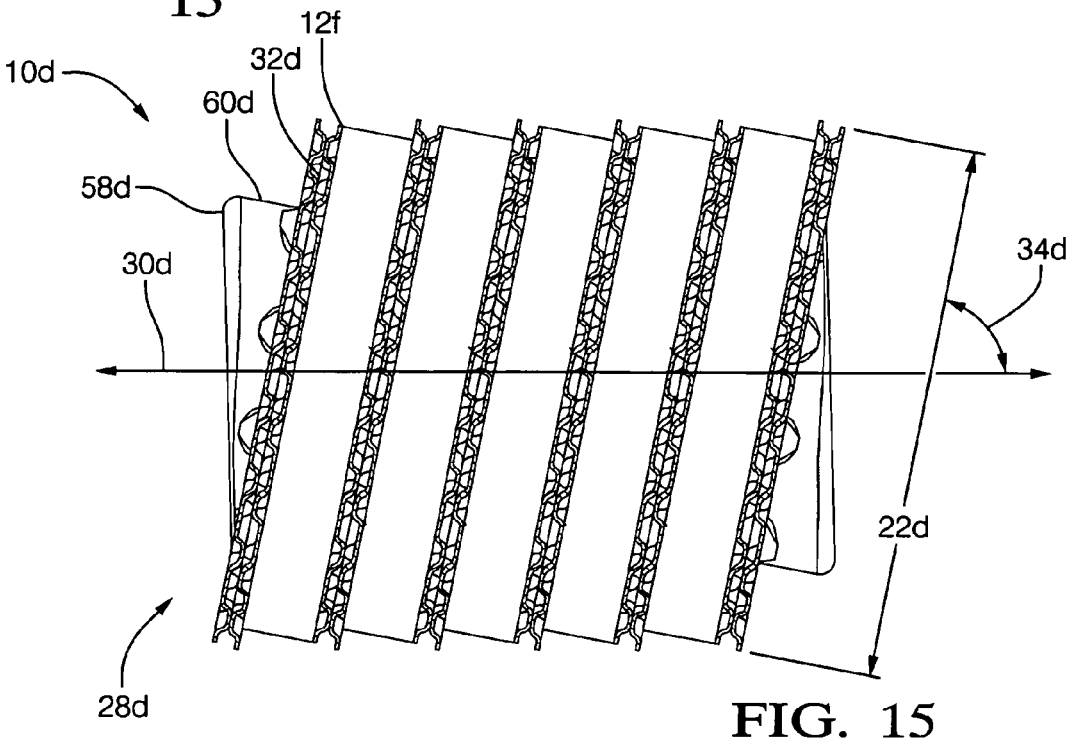
FIG. 15 is a cross-sectional view taken along section lines 15-15 in FIG. 14.

Referring now to FIGS. 13-15, in a fifth exemplary of the invention, a heat exchanger 10*d* includes a plurality of plates 12*f* stacked in alternating mirrored relation with one another, similar to the plates 12-12*b* of FIGS. 1-3. Each of the plurality of plates 12*f* has a plate length 14*d* extending along a plate longitudinal axis 16*d* between first and second ends 18*d*, 20*d*. As best shown in FIG. 15, each of the plurality of plates 12*f* also has a plate width 22*d* extending transverse to the plate longitudinal axis 16*d*.

The plates 12*f* cooperate to define a fluid receiving cavity 24*d* extending along a receiving axis 26*d* substantially perpendicular to the plate longitudinal axis 16*d*. FIG. 13 shows a portion of the fluid receiving cavity 24*d* that is defined by the single plate 12*f*. The plates 12*f* also cooperate to define a fluid exiting cavity 28*d* extending along an exiting axis 30*d* substantially perpendicular to the plate longitudinal axis 16*d* and spaced from the receiving axis 26*d*. FIG. 13 shows a portion of the fluid exiting cavity 28*d* that is defined by the single plate 12*f*. The fluid receiving cavity 24*d* is disposed at the first end 20*d* and the fluid exiting cavity 28*d* is disposed at the second end 18*d*. The plates 12*f* also cooperate to define a plurality of plate cavities 32*d* between alternating pairs of adjacent plates 12*f*. Two plates 12*f* engaged face-to-face cooperate to define a single plate cavity 32*d*.

Each of the plurality of plates 12*f* includes a substantially planar body portion 36*d* defining the plate length 14*d* and the plate width 22*d* and a cup portion 38*d* disposed at one of the first and second ends 18*d*, 20*d*. The cup portion 38*d* extends between a rim portion 40*d* in a first plane to a bottom portion 42*d* spaced from the first plane. The cup portions 38*d* of all of the plurality of plates 12*f* cooperate to define the fluid receiving cavity 24*d*. A cup portion 76*d* is structured similarly as the cup portion 38*d* and the cup portions 76*d* of all of the plurality of plates 12*f* cooperate to define the fluid exiting cavity 28*d*. Description of the cup portion 38*d* is applicable to the cup portion 76*d*.

The plate 12*f* includes a lip 78*d* extending around the face-up surface of the planar body portion 36*d* and the cup portion 38*d* and the cup portion 76*d*. The rim 40*d* is a portion of the lip 78*d*. The lips 78*d* of adjacent, face-to face plates 12*f* are engaged to one another to seal the interior defined between the outline of the lip 78*d*. For example, the volume defined between bottom portions 42*d* of adjacent plates 12*f* is a portion of the fluid receiving cavity 24*d*. Bosses extend from a surface recessed from the lip 78*d*.

The bottom portion 42*d* includes an opening portion 46*d* to communicate fluid to the fluid receiving cavity 24*d*. The opening portion 24*d* includes first and second apertures 48*d*, 50*d*. In one possible mode of operation, a fluid stream can pass through apertures 48*d*, 50*d* and enter the volume defined between bottom portions 42*d* of adjacent plates 12*f*. A first portion of the fluid stream can pass through apertures 48*d*, 50*d* of a first plate 12*f*, the volume defined between bottom portions 42*d*, and further through apertures 48*d*, 50*d* formed in a second plate 12*f* to move in the fluid receiving cavity 24*d* along the receiving axis 26*d*. A second portion of the fluid stream can pass through gaps defined between the bosses, moving into the plate cavity 32*d* along the axis 16*d* towards the fluid exiting cavity 28*d*. The plate cavities 32*d* extend along the plate length 14*d* and fluidly communicate with both of the receiving and exiting cavities 24*d*, 28*d*. The fifth exemplary embodiment is a single pass heat exchanger, however alternative embodiments of the invention can be a multi-pass heat exchanger.

The plate width 22*d* is disposed at an angle 34*d* less than ninety degrees relative to both of the receiving and exiting axis 26*d*, 30*d*. The receiving and exiting axis 26*d*, 30*d* are coplanar. The angle 34*d* can be selected in view of the operating environment of the heat exchanger 10*d* such that the body portions 36*d* are substantially incident with fluid flow external to the heat exchanger. This can be desirable to reduce external fluid flow pressure drop across the heat exchanger 10*d*. Also, the angle 34*d* can be selected in view of the desired orientation of the receiving and exiting axis 26*d*, 30*d*.

In the fifth exemplary of the invention, the plate width 22*d* can be disposed at an angle 34*d* less than ninety degrees relative to both of the receiving and exiting axis 26*d*, 30*d* by disposing the apertures 48*d* and 50*d* in one or more planes transverse to the body portion 36*d*. The body portion 36*d* and the rim portion 40*d*, disposed in the first plane, are substantially parallel to one another. The bottom portion 42*b* extends in a second plane transverse to the first plane and to the body portion 36*d*. The apertures 48*d*, 50*d* are centered with respect to the axis 16*d*. Where first and second plates 12*f* are engaged back-to back, the aperture 48*d* of a first plate 12*f* will engage the aperture 50*d* of the second plate 12*f*. The bottom portion 42*d* includes a first outer surface 58*d* extending perpendicular to the receiving axis 26*d*. A second outer surface 60*d* is adjacent to the first outer surface 58*d* and extends transverse to the receiving axis 26*b*. In alternative embodiments of the invention, the second outer surface 60*d* could extend parallel to the receiving axis 26*b*. The surfaces 58*d*, 60*d* can be desirable for mounting or locating the heat exchanger 10*d* in a fluid diffuser.

Figure 16:
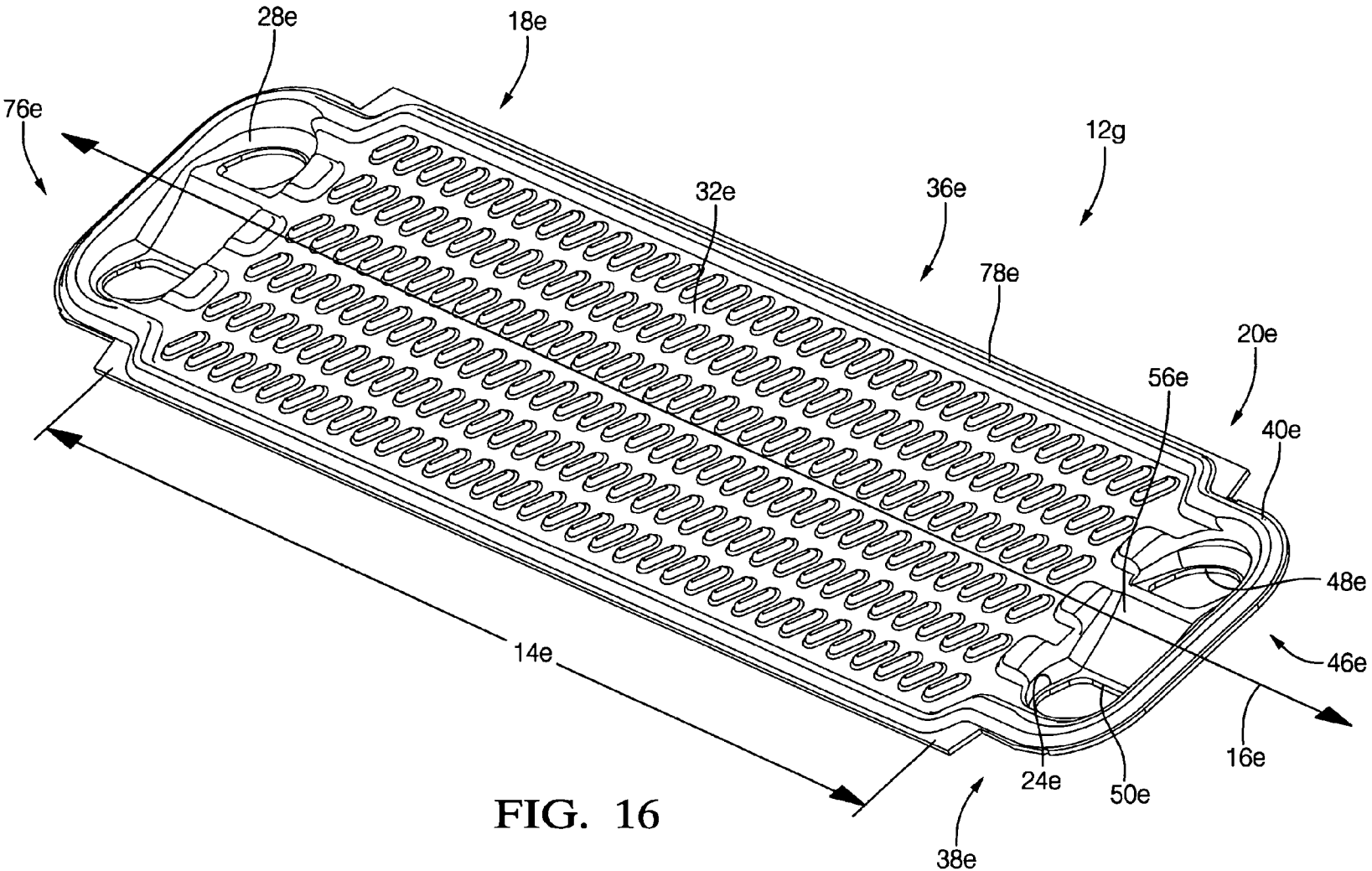
FIG. 16 is a perspective view of a sixth plate according to a sixth exemplary embodiment of the invention.
Figure 17:
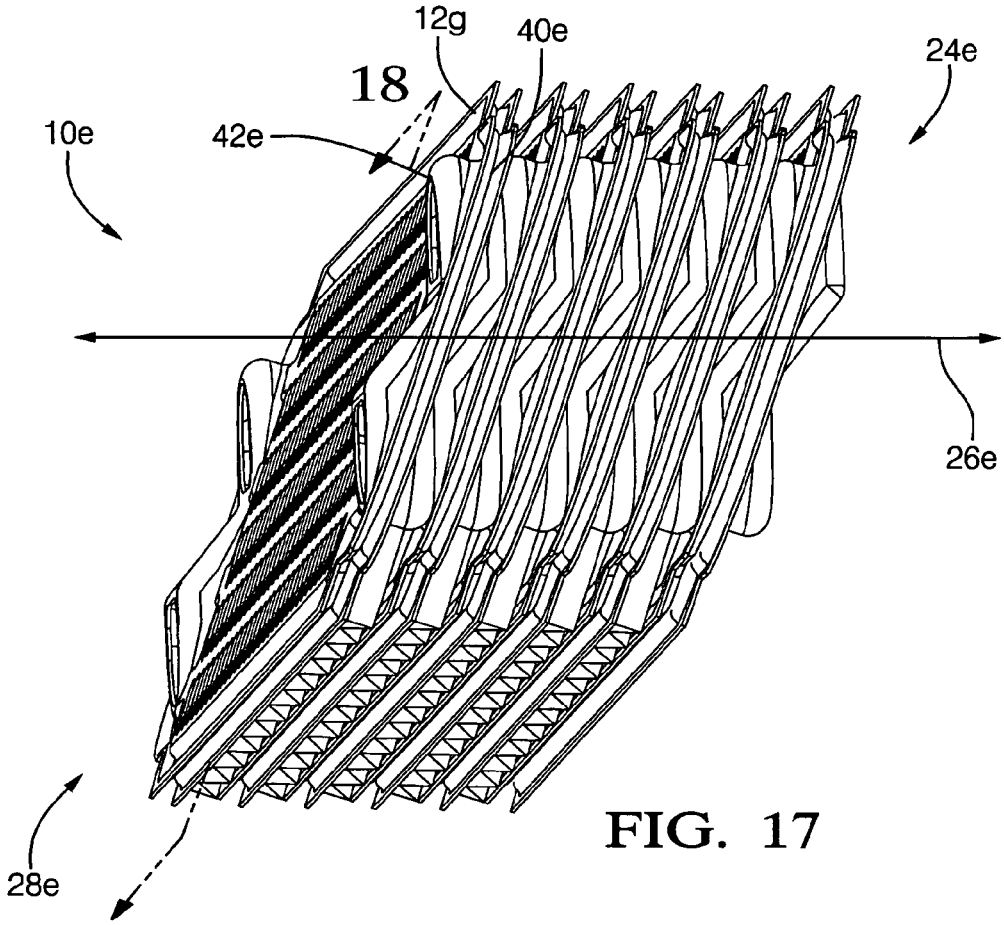
FIG. 17 is a perspective view of the sixth exemplary embodiment of the invention having a plurality of stacked sixth plates.
Figure 18:
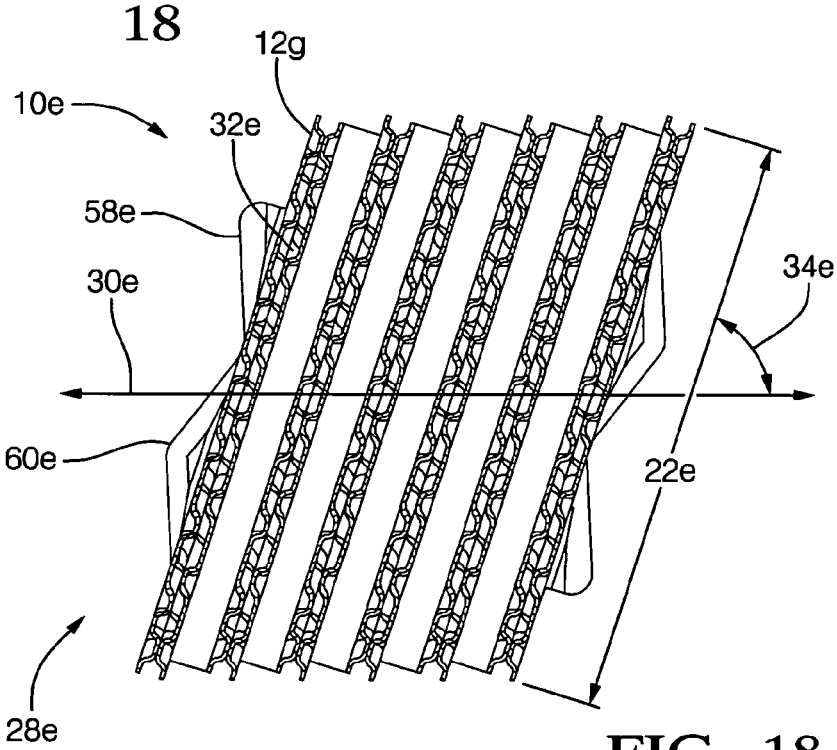
FIG. 18 is a cross-sectional view taken along section lines 18-18 in FIG. 17.

Referring now to FIGS. 16-18, in a sixth exemplary of the invention, a heat exchanger 10*e* includes a plurality of plates 12*g* stacked in alternating mirrored relation with one another, similar to the plates 12-12*b* of FIGS. 1-3. Each of the plurality of plates 12*g* has a plate length 14*e* extending along a plate longitudinal axis 16*e* between first and second ends 18*e*, 20*e*. As best shown in FIG. 18, each of the plurality of plates 12*e* also has a plate width 22*e* extending transverse to the plate longitudinal axis 16*e*.

The plates 12*g* cooperate to define a fluid receiving cavity 24*e* extending along a receiving axis 26*e* substantially perpendicular to the plate longitudinal axis 16*e*. FIG. 16 shows a portion of the fluid receiving cavity 24*e* that is defined by the single plate 12*g*. The plates 12*g* also cooperate to define a fluid exiting cavity 28*e* extending along an exiting axis 30*e* substantially perpendicular to the plate longitudinal axis 16*e* and spaced from the receiving axis 26*e*. FIG. 16 shows a portion of the fluid exiting cavity 28*e* that is defined by the single plate 12*g*. The fluid receiving cavity 24*e* is disposed at the first end 20*e* and the fluid exiting cavity 28*e* is disposed at the second end 18*e*. The plates 12*g* also cooperate to define a plurality of plate cavities 32*e* between alternating pairs of adjacent plates 12*g*. Two plates 12*g* engaged face-to-face cooperate to define a single plate cavity 32*e*.

Each of the plurality of plates 12*g* includes a substantially planar body portion 36*e* defining the plate length 14*e* and the plate width 22*e* and a cup portion 38*e* disposed at one of the first and second ends 18*e*, 20*e*. The cup portion 38*e* extends between a rim portion 40*e* in a first plane to a bottom portion 42*e* spaced from the first plane. The cup portions 38*e* of all of the plurality of plates 12*g* cooperate to define the fluid receiving cavity 24*e*. A cup portion 76*e* is structured similarly as the cup portion 38*e* and the cup portions 76*e* of all of the plurality of plates 12*g* cooperate to define the fluid exiting cavity 28*e*. Description of the cup portion 38*e* is applicable to the cup portion 76*e*.

The plate 12*g* includes a lip 78*e* extending around the face-up surface of the planar body portion 36*e* and the cup portion 38*e* and the cup portion 76*e*. The rim 40*e* is a portion of the lip 78*e*. The lips 78*e* of adjacent, face-to face plates 12*g* are engaged to one another to seal the interior defined between the outline of the lip 78*e*. For example, the volume defined between bottom portions 42*e* of adjacent plates 12*g* is a portion of the fluid receiving cavity 24*e*. Bosses extend from a surface recessed from the lip 78*e*.

The bottom portion 42*e* includes an opening portion 46*e* to communicate fluid to the fluid receiving cavity 24*e*. The opening portion 24*e* includes first and second apertures 48*e*, 50*e*. In one possible mode of operation, a fluid stream can pass through apertures 48*e*, 50*e* and enter the volume defined between bottom portions 42*e* of adjacent plates 12*g*. A first portion of the fluid stream can pass through apertures 48*e*, 50*e* of a first plate 12*g*, the volume defined between bottom portions 42*e*, and further through apertures 48*e*, 50*e* formed in a second plate 12*g* to move in the fluid receiving cavity 24*e* along the receiving axis 26*e*. A second portion of the fluid stream can pass through gaps defined between the bosses, moving into the plate cavity 32*e* along the axis 16*e* towards the fluid exiting cavity 28*e*. The plate cavities 32*e* extend along the plate length 14*e* and fluidly communicate with both of the receiving and exiting cavities 24*e*, 28*e*. The sixth exemplary embodiment is a single pass heat exchanger, however alternative embodiments of the invention can be a multi-pass heat exchanger.

The plate width 22*e* is disposed at an angle 34*e* less than ninety degrees relative to both of the receiving and exiting axis 26*e*, 30*e*. The receiving and exiting axis 26*e*, 30*e* are coplanar. The angle 34*e* can be selected in view of the operating environment of the heat exchanger 10*e* such that the body portions 36*e* are substantially incident with fluid flow external to the heat exchanger. This can be desirable to reduce external fluid flow pressure drop across the heat exchanger 10*e*. Also, the angle 34*e* can be selected in view of the desired orientation of the receiving and exiting axis 26*e*, 30*e*.

In the sixth exemplary of the invention, the plate width 22*e* can be disposed at an angle 34*e* less than perpendicular relative to both of the receiving and exiting axis 26*e*, 30*e* by disposing the apertures 48*e* and 50*e* in one or more planes transverse to the body portion 36*e*. The body portion 36*e* and the rim portion 40*e*, disposed in the first plane, are substantially parallel to one another. The bottom portion 42*e* extends in second and third planes parallel and spaced from one another. The aperture 48*e* is defined in the second plane and the aperture 50*e* is disposed in the third plane. Both of the second and third planes are transverse to body portion 36*e*, as best shown in FIG. 16. The apertures 48*e*, 50*e* are centered with respect to the axis 16*e*. Where first and second plates 12*g* are engaged back-to back, the aperture 48*e* of a first plate 12*g* will engage the aperture 50*e* of the second plate 12*g*. A transition portion 56*e* extends between the second and third planes transverse and spaced from the plate longitudinal axis 16*e*. The bottom portion 42*e* includes a first outer surface 58*e* extending perpendicular to the receiving axis 26*e* and a second outer surface 60*e* adjacent to the first outer surface 58*e* and extending transverse to the receiving axis 26*e*. The surfaces 58*e*, 60*e* can be desirable for mounting or locating the heat exchanger 10*e* in a fluid diffuser.

The structural features of the six embodiments can vary based on three considerations—manufacturability, achievable angle of attack of the incoming air into the HVAC module and the ability to seal the HVAC module after placement of the evaporator core within the HVAC module. The choice of a particular embodiment in an HVAC module may be dictated by any one or combination of these three considerations. The manufacturability may be an important consideration from the standpoint of cost savings. The angle of attack is often responsive to the constraints imposed by the particular design of the air conditioning system. Sealing of the HVAC module is a consideration to reduce the likelihood of noise free operation of the air conditioning system without loss of its cooling capacity. A perceived advantage of the first embodiment is that it is probably the easiest to manufacture with the cup side wall perpendicular to the plate plane. A possible drawback of this embodiment is the relatively shallow angle of attack of the incoming air. The perceived advantage of the second embodiment, with non-perpendicular cup side wall with reference to the plate plane, is that it affords ease of assembly into the HVAC module and as such desirable sealing of the HVAC module. It may improve the angle of attack of the incoming over the first embodiment, but not appreciably. A perceived advantage of the third embodiment, with dual-step cup construction, is that it affords flexibility of a large angle of attack of the incoming air stream facilitated by the large slant of the cup wall. The fourth embodiment, with twisted plates, offers the same advantage as the third embodiment with respect to the angle of attack of the incoming air stream, the difference being the method of forming the cups. The fifth embodiment, with triangular cup construction, offers the same advantage as the third and fourth embodiments as regarded the angle of attack of the incoming air, the difference being in the fifth embodiment the angle of attack is achieved simply by the stamping operation during the course of the plate fabrication. The sixth embodiment, with two-step cup, offers the same advantage as the fifth embodiment with the added advantage that it further increases the angle of attack range.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger comprising:

a plurality of plates stacked in alternating mirrored relation with one another, each of said plurality of plates having a plate length extending along a plate longitudinal axis between first and second ends and a plate width extending transverse to said plate longitudinal axis and said plurality of plates cooperating to define a fluid receiving cavity extending along a receiving axis and a fluid exiting cavity extending along an exiting axis spaced from said receiving axis and a plurality of plate cavities each defined between alternating pairs of adjacent plates and extending along said plate length and fluidly communicating with both of said receiving and exiting cavities; wherein both of said receiving and exiting axes are substantially perpendicular to said plate longitudinal axis and wherein said plate width is disposed at an angle less than ninety degrees relative to both of said receiving and exiting axes.

2. The heat exchanger of claim 1 wherein each of said plurality of plates includes a substantially planar body portion defining said plate length and said plate width and a cup portion disposed at one of said first and second ends and extending between a rim portion in a first plane to a bottom portion spaced from said first plane, said cup portions of said plurality of plates cooperating to define said fluid receiving cavity.

3. The heat exchanger of claim 2 wherein said substantially planar body portion and said first plane are transverse to one another.

4. The heat exchanger of claim 3 wherein said bottom portion extends in a second plane substantially parallel to said first plane.

5. The heat exchanger of claim 2 wherein said substantially planar body portion and said first plane are substantially parallel to one another.

6. The heat exchanger of claim 5 wherein said bottom portion extends in a second plane substantially parallel to said substantially planar body portion.

7. The heat exchanger of claim 5 wherein said bottom portion extends in a second plane transverse with respect to said first plane.

8. The heat exchanger of claim 2 wherein said bottom portion extends in a second and third planes parallel and spaced from one another.

9. The heat exchanger of claim 2 wherein said cup portion includes a cup longitudinal axis extending between said rim portion and said bottom portion perpendicular to said plate longitudinal axis and wherein said bottom portion includes an opening portion to communicate fluid to said fluid receiving cavity centered on a point spaced from said cup longitudinal axis.

10. The heat exchanger of claim 9 wherein said opening portion includes first and second apertures having respective first and second centers wherein one of said first and second centers is closer to said cup longitudinal axis than the other of said first and second centers.

11. The heat exchanger of claim 2 wherein said bottom portion includes an opening portion centered to communicate fluid to said fluid receiving cavity with respect to said bottom portion.

12. The heat exchanger of claim 11 wherein said opening portion includes first and second apertures disposed in parallel second and third planes spaced from one another.

13. The heat exchanger of claim 12 wherein said opening portion includes a transition portion extending between said second and third planes perpendicular to said plate longitudinal axis.

14. The heat exchanger of claim 12 wherein said opening portion includes a transition portion extending between said second and third planes spaced from said plate longitudinal axis.

15. The heat exchanger of claim 2 wherein said bottom portion includes a first outer surface extending perpendicular to said receiving axis.

16. The heat exchanger of claim 15 wherein said bottom portion includes a second outer surface adjacent to said first outer surface and extending parallel to said receiving axis.

17. The heat exchanger of claim 15 wherein said bottom portion includes a second outer surface adjacent to said first outer surface and extending transverse to said receiving axis.

18. The heat exchanger of claim 1 wherein said fluid receiving cavity is disposed at said first end and said fluid exiting cavity is disposed at said second end.

19. The heat exchanger of claim 1 further comprising:

a fluid diffuser having an inlet and an outlet and a receiving portion and a first fluid passageway extending along an arcuate path between said inlet and said receiving portion and a second fluid passageway extending along a straight path between said receiving portion and said outlet, wherein said plurality of plates are received in said receiving portion and divert a fluid stream moving through said fluid diffuser transverse to said second fluid passageway.

* * * * *